US008641388B2

(12) United States Patent
Mandica

(10) Patent No.: US 8,641,388 B2
(45) Date of Patent: Feb. 4, 2014

(54) HOUSEHOLD ELECTRIC APPLIANCE HAVING A PIEZOELECTRIC PUMP

(75) Inventor: Franck Mandica, Francheville (FR)

(73) Assignee: SEB S.A. (FR)

( * ) Notice: Subject to any disclaimer, the term of this patent is extended or adjusted under 35 U.S.C. 154(b) by 454 days.

(21) Appl. No.: 13/001,209

(22) PCT Filed: Jun. 19, 2009

(86) PCT No.: PCT/FR2009/000739

§ 371 (c)(1),
(2), (4) Date: Dec. 23, 2010

(87) PCT Pub. No.: WO2010/007227

PCT Pub. Date: Jan. 21, 2010

(65) Prior Publication Data

US 2011/0103980 A1 May 5, 2011

(30) Foreign Application Priority Data

Jun. 24, 2008 (FR) ..... 08 03520

(51) Int. Cl.
*F04B 49/06* (2006.01)

(52) U.S. Cl.
USPC ..... 417/413.2; 310/331

(58) Field of Classification Search
USPC ..... 417/413.2; 310/330, 331; 38/75, 77.1, 38/77.83
See application file for complete search history.

(56) References Cited

U.S. PATENT DOCUMENTS

2004/0000843 A1 1/2004 East

FOREIGN PATENT DOCUMENTS

EP 0610569 A1 8/1994

*Primary Examiner* — Charles Freay
*Assistant Examiner* — Patrick Hamo
(74) *Attorney, Agent, or Firm* — The Webb Law Firm

(57) ABSTRACT

The invention relates to an electric household appliance comprising a pump having a pumping chamber (11) including a movable wall formed by a diaphragm (12) made of an electrically conductive material comprising an inner surface covered with at least one layer (21) made of an electrically insulating material, and an outer surface, in contact with a piezoelectric actuator (13), characterized in that power is supplied to said piezoelectric actuator (13) by the voltage of a domestic power grid without inserting an insulation transformer therebetween, and in that said inner surface of the metal diaphragm (12) is covered by at least one first electrically insulating layer (21), having flame retardant properties, and by two additional electrically insulating layers (22, 23) of a lower thickness.

15 Claims, 2 Drawing Sheets

HOUSEHOLD ELECTRIC APPLIANCE HAVING A PIEZOELECTRIC PUMP

BACKGROUND OF THE INVENTION

1. Field of the Invention

The present invention relates to a household electric appliance equipped with a piezoelectric pump and more particularly relates to a household electric appliance in which the piezoelectric actuator is electrically powered by the mains voltage without using an isolation transformer.

2. Description of Related Art

European patent #610 569 discloses a clothing iron having a piezoelectric pump for supplying a vaporization chamber with water from a storage vessel. This document describes the presence of a layer of electrically insulating material on the surface of the metal membrane in contact with the water in the pumping chamber. Such a document, however, does not describe the nature of the electrically insulating material applied to the metal membrane.

The application of a layer of insulating material to the metal membrane has the disadvantage of reducing the performance of the pump by limiting the vibration amplitude of the membrane. This problem becomes even more significant when the excitation voltage of the piezoelectric actuator is relatively weak, for example less than 120 V, which is in particular the case when the pump is powered by the domestic mains voltage in certain countries such as the USA. Furthermore, the standards in effect in certain countries, in particular the UL standards in the USA, impose additional constraints on the construction of the piezoelectric pump.

As a consequence, the selection of an insulating material to apply to the metal membrane poses a significant technical problem for the skilled professional.

An object of the present invention is therefore to propose a household electric appliance having a piezoelectric pump powered by the domestic mains voltage, without the interposition of an isolation transformer, which is capable of operating with a satisfactory output in most countries, particularly in the USA where the supply voltage is weak and where the appliance must comply with UL safety standards.

SUMMARY OF THE INVENTION

To this end, the invention has as an object a household electric appliance having a pump equipped with a pumping chamber comprising a mobile wall formed by a membrane of electrically conductive material having an inner surface oriented to the inside of the pumping chamber and covered with at least one layer of electrically insulating material, and an outer surface in contact with a piezoelectric actuator provided to displace the membrane and force liquid from the pumping chamber by altering the volume of the pumping chamber under the action of the piezoelectric actuator, characterized in that the piezoelectric actuator is powered by the voltage from a domestic mains, without interposition of an isolation transformer, and further characterized in that the inner surface of the metal membrane is covered with at least a first electrically insulating layer possessing flame retardant properties and two supplementary electrically insulating layers each having a thickness less than the thickness of the first electrically insulating layer.

"Flame retardant properties" is understood to mean a material capable of slowing the spread of flames.

The reduced thickness of the two supplementary layers makes it possible to maintain good flexibility of the metal membrane coated with insulating layers, which in turn makes it possible to maintain satisfactory pump output yet still respect the UL standards in effect in the USA.

According to still another characteristic of the invention, the first layer consists of an adhesive tape having a polyester film held in place on the surface of the metal membrane by a flame retardant acrylic adhesive.

According to still another characteristic of the invention, the polyester film of the first layer has a thickness of around 60 μm.

Such a first layer can consist of, for example, a layer of adhesive tape with flame retardant properties sold by the 3M company under item number 1350.

According to still another characteristic of the invention, the two supplementary electrically insulating layers consist of adhesive tapes having a polyester film held in place by a heat-bonded adhesive.

According to another characteristic of the invention, the polyester film of the two supplementary layers has a thickness of around 20 μm.

These two supplementary layers may consist of, for example, an adhesive tape sold by the 3M company under item number 74.

According to another characteristic of the invention, the appliance is an appliance for treating clothing.

According to another characteristic of the invention, the pump is used to supply water to a vaporization chamber in order to generate steam.

According to another characteristic of the invention, the appliance is a clothing iron.

BRIEF DESCRIPTION OF THE DRAWINGS

The objectives, aspects, and advantages of the present invention will emerge more clearly from the following description of an illustrative embodiment of the invention, which is provided as a non-limiting example and which refers to the appended drawings, in which:

Only the elements necessary for understanding the invention have been shown. In order to make the drawings easier to read, the same elements have the same reference numbers from one figure to another.

FIG. 1 shows a clothing iron 1 having a piezoelectric pump 10 connected on one of its ends to a storage vessel 2 and on the other of its ends to a vaporization chamber 3, the vaporization chamber 3 being comprised in a heating sole 4 provided with openings for dispensing steam, which are not shown in the figure.

Figure 1:
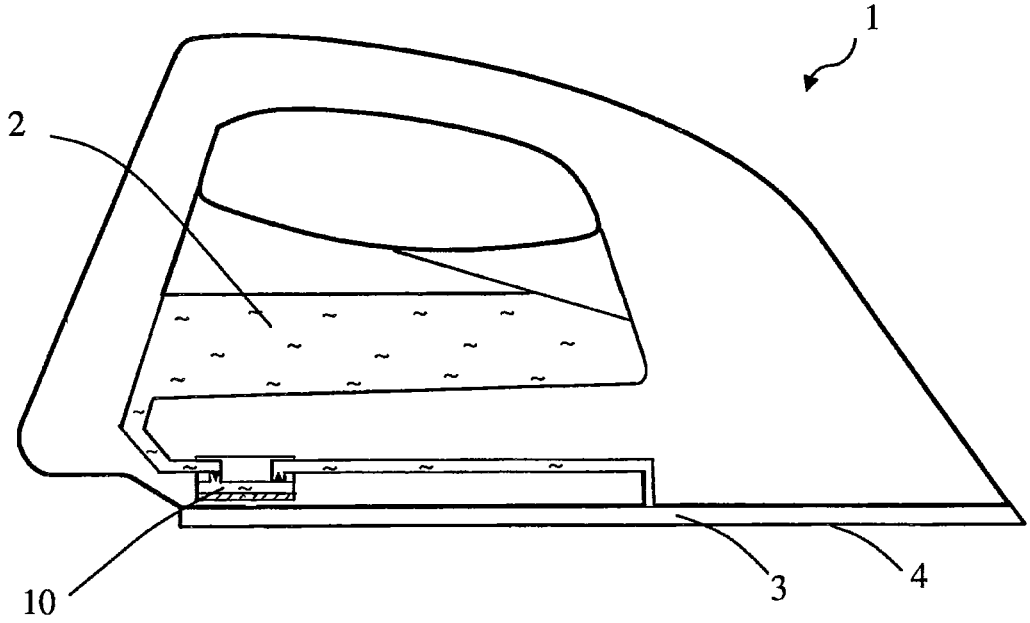
FIG. 1 is a schematic cutaway view of the appliance according to a particular embodiment of the invention.
Figure 2:
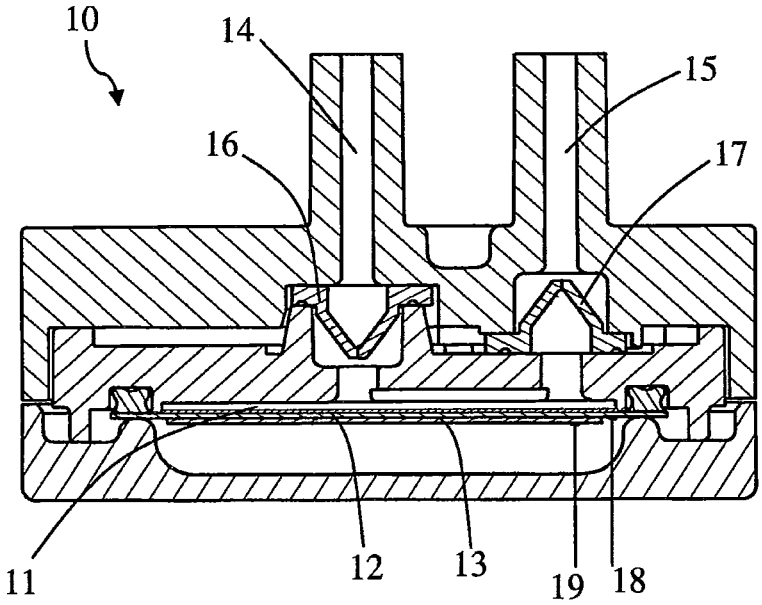
FIG. 2 is a cutaway view of the piezoelectric pump of the appliance of FIG. 1.

According to FIG. 2, the piezoelectric pump 10 has an advantageously circular pumping chamber 11 comprising a mobile bottom wall formed by a flexible brass membrane 12. The membrane 12 has an inner surface oriented toward the pumping chamber 11 and has an outer surface on which is attached a ceramic piezoelectric actuator 13. The pumping chamber 11 has a top wall equipped with an inlet pipe 14 connected to the storage vessel 2 and an outlet pipe 15 connected to the vaporization chamber 3.

The piezoelectric pump 10 has an electric terminal 18 attached to the membrane 12 and an electric terminal 19 attached to the piezoelectric actuator 13. The pump 10 is supplied with power at its terminals 18, 19 by an alternating supply voltage inducing a periodic deformation of the piezoelectric actuator 13 and thus the flexible membrane 12 in the direction of increasing and then reducing the volume of the pumping chamber 11.

The supply voltage for the piezoelectric actuator 13 is furnished directly from the domestic mains by means of a power supply circuit, which is not shown in the figures and which is not equipped with an isolation transformer. An example of such a circuit for supplying power to the piezoelectric pump is described in French patent #08 0176, filed by the applicant.

The outlet pipe 15 has, in a manner known per se, a check valve 17 that closes and prevents the aspiration of water present downstream from the valve 17 when the piezoelectric actuator deforms in the direction of increasing the volume of the pumping chamber 11. The inlet pipe 14 likewise has a check valve 16 that opens and thus allows water present in the inlet pipe 14, supplied from the storage vessel 2, to be aspirated into the pumping chamber 11.

Conversely, when the piezoelectric actuator 13 deforms in such a way that the volume of the pumping chamber 11 decreases, the valve 16 of the inlet pipe 14 closes while the valve 17 of the outlet pipe 15 simultaneously opens. Water will thus pass from the pumping chamber 11 to the vaporization chamber 3.

Figure 3:
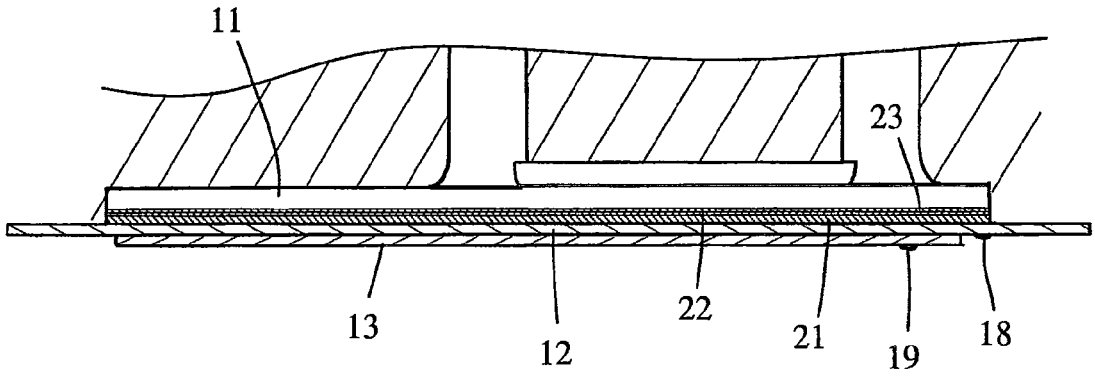
FIG. 3 is a magnified partial view of the pump of FIG. 2.

According to FIG. 3, the inner surface of the flexible membrane 12 is covered with three electrically insulating layers 21, 22, 23 glued onto one another, each layer having a dielectric strength greater than 3000 V.

The first layer 21, which comes into contact with the inner surface, advantageously consists of a polyester adhesive film with a thickness of around 60 μm associated with a flame retardant acrylic adhesive such as the one sold by the 3M company under item number 1350. Such a first layer 21 has the advantage of possessing a dielectric strength greater than 3000 V and flame retardant properties compliant with UL standard R/C OANZ2 in effect in the USA. However, such a layer 21 has the disadvantage of possessing a substantial thickness, which increases the rigidity of the metal membrane and decreases the performance of the pump in such a way that the use of three layers of this insulator would render the pump 10 inoperative or inefficient.

In order to solve this problem, the two supplementary layers 22, 23 glued on top of the first layer consist of adhesive polyester films with a lesser thickness of around 20 μm and possessing a dielectric strength greater than 3000 V, but not possessing flame retardant properties. For example, the two supplementary layers 22, 23 consist of adhesive films sold by the 3M company under item number 74.

Such a piezoelectric pump 10 has the advantage of maintaining sufficient performance for supplying the vaporization chamber 3 with a flow rate sufficient for generating steam with a constant flow rate of around 40 g/min.

Thus a household electric appliance is obtained having a pump with a metal membrane that is insulated from water by three insulating layers, in compliance with the UL standards in effect in the USA, which has the advantage of being efficient and economical to operate, the piezoelectric pump being supplied directly from the domestic mains without interposition of an isolation transformer.

Obviously the invention is in no way limited to the embodiment described and illustrated herein, which was provided solely as an example. Modifications are possible, particularly in terms of the constitution of various elements or by substituting equivalent techniques, without in any way exceeding the scope of protection of the invention.

Hence in a variant of embodiment of the invention, the flexible membrane can consist of a metallic material other than brass.

The invention claimed is:

1. A household electric appliance having a pump equipped with a pumping chamber comprising a mobile wall formed by a metal membrane of electrically conductive material having an inner surface oriented to the inside of the pumping chamber and covered with at least one layer of electrically insulating material and the metal membrane also having an outer surface in contact with a piezoelectric actuator provided for displacing said metal membrane and forcing liquid from the pumping chamber by altering the volume of the pumping chamber under the action of said piezoelectric actuator, wherein said piezoelectric actuator is powered by voltage from a domestic mains, without interposition of an isolation transformer, and further wherein said inner surface of the metal membrane is covered with the at least one first electrically insulating layer possessing flame retardant properties and two electrically insulating supplementary layers each having a thickness less than the thickness of the at least one first electrically insulating layer.

2. The household electric appliance as in claim 1, wherein said at least one first electrically insulating layer consists of an adhesive tape having a polyester film held in place on the surface of the metal membrane by means of a flame retardant acrylic adhesive.

3. The household electric appliance as in claim 2, wherein the polyester film of the at least one first electrically insulating layer has a thickness of around 60 μm.

4. The household electric appliance as in claim 1, wherein said two supplementary electrically insulating layers consist of adhesive tapes having a polyester film held in place by a heat-bonded adhesive.

5. The household electric appliance as in claim 4, wherein the polyester film of the two supplementary layers has a thickness of around 20 μm.

6. The household electric appliance as in claim 1, wherein said appliance is an appliance for treating clothing.

7. The household electric appliance as in claim 6, wherein said pump is used for supplying water to a vaporization chamber for generating steam.

8. The household electric appliance as in claim 6, wherein said appliance is a clothing iron.

9. The household electric appliance as in claim 7, wherein said appliance is a clothing iron.

10. The household electric appliance as in claim 2, wherein said two supplementary electrically insulating layers consist of adhesive tapes having a polyester film held in place by a heat-bonded adhesive.

11. The household electric appliance as in claim 3, wherein said two supplementary electrically insulating layers consist of adhesive tapes having a polyester film held in place by a heat-bonded adhesive.

12. The household electric appliance as in claim 2, wherein said appliance is an appliance for treating clothing.

13. The household electric appliance as in claim 3, wherein said appliance is an appliance for treating clothing.

14. The household electric appliance as in claim 4, wherein said appliance is an appliance for treating clothing.

15. The household electric appliance as in claim 5, wherein said appliance is an appliance for treating clothing.

* * * * *